US008922106B2

(12) United States Patent
Helbing et al.

(10) Patent No.: US 8,922,106 B2
(45) Date of Patent: Dec. 30, 2014

(54) LIGHT SOURCE WITH OPTICS TO PRODUCE A SPHERICAL EMISSION PATTERN

(75) Inventors: Rene Helbing, Sunnyvale, CA (US); Keith Scott, Sunnyvale, CA (US); Jason Posselt, Sunnyvale, CA (US)

(73) Assignee: Bridgelux, Inc., Sunnyvale, CA (US)

( * ) Notice: Subject to any disclaimer, the term of this patent is extended or adjusted under 35 U.S.C. 154(b) by 550 days.

(21) Appl. No.: 12/645,234

(22) Filed: Dec. 22, 2009

(65) Prior Publication Data

US 2010/0301726 A1 Dec. 2, 2010

Related U.S. Application Data

(60) Provisional application No. 61/183,437, filed on Jun. 2, 2009.

(51) Int. Cl.

| | |
|---|---|
| ***H01J 5/48*** | (2006.01) |
| ***H01J 5/50*** | (2006.01) |
| ***F21V 7/04*** | (2006.01) |
| ***F21K 99/00*** | (2010.01) |
| *F21Y 101/02* | (2006.01) |

(52) U.S. Cl.

CPC . *F21K 9/135* (2013.01); *F21V 7/04* (2013.01); *F21Y 2101/02* (2013.01)

USPC ..... 313/318.11; 313/46; 313/483; 313/498

(58) Field of Classification Search

USPC ..... 362/514, 516, 517, 237, 240, 241, 247, 362/249.02; 313/46, 498, 501, 113, 114, 313/116, 318.01–12

See application file for complete search history.

(56) References Cited

U.S. PATENT DOCUMENTS

| | | | | |
|---|---|---|---|---|
| 5,606,181 | A | 2/1997 | Sakuma et al. | |
| 5,642,933 | A * | 7/1997 | Hitora | 362/243 |
| 5,865,529 | A * | 2/1999 | Yan | 362/327 |
| 6,183,100 | B1 * | 2/2001 | Suckow et al. | 362/35 |
| 6,218,785 | B1 * | 4/2001 | Incerti | 315/185 S |
| 6,220,722 | B1 * | 4/2001 | Begemann | 362/231 |
| 6,350,041 | B1 * | 2/2002 | Tarsa et al. | 362/231 |
| 6,364,506 | B1 * | 4/2002 | Gallo | 362/245 |
| 6,464,373 | B1 * | 10/2002 | Petrick | 362/235 |

(Continued)

FOREIGN PATENT DOCUMENTS

| | | |
|---|---|---|
| DE | 102007056874 A1 | 5/2009 |
| EP | 1692557 A2 | 8/2006 |

(Continued)

OTHER PUBLICATIONS

PCT/US2010/37119-Notification of transmittal of the international search report and the written opinion of the international searching authority, or the declaration.Aug. 17, 2010.

(Continued)

*Primary Examiner* — Thomas A Hollweg
(74) *Attorney, Agent, or Firm* — Arent Fox LLP

(57) ABSTRACT

A light emitting apparatus includes a substrate, a plurality of solid state light emitting cells having a planar arrangement on the substrate, and one or more reflectors arranged with the solid state light emitting cells so that light emitted from the light source has a substantially spherical emission pattern.

51 Claims, 5 Drawing Sheets

(56) References Cited

U.S. PATENT DOCUMENTS

| | | | | |
|---|---|---|---|---|
| 6,674,096 | B2 * | 1/2004 | Sommers | 257/98 |
| 6,679,618 | B1 * | 1/2004 | Suckow et al. | 362/247 |
| 6,793,374 | B2 * | 9/2004 | Begemann | 362/294 |
| 6,846,101 | B2 * | 1/2005 | Coushaine | 362/517 |
| 7,011,432 | B2 * | 3/2006 | Chen et al. | 362/256 |
| 7,080,924 | B2 * | 7/2006 | Tseng et al. | 362/241 |
| 7,118,262 | B2 * | 10/2006 | Negley | 362/555 |
| 7,144,140 | B2 * | 12/2006 | Sun et al. | 362/373 |
| 7,172,307 | B2 * | 2/2007 | Izardel | 362/183 |
| 7,347,586 | B2 * | 3/2008 | Izardel | 362/247 |
| 7,413,325 | B2 * | 8/2008 | Chen | 362/249.01 |
| 7,833,811 | B2 * | 11/2010 | Han et al. | 438/27 |
| 7,847,471 | B2 * | 12/2010 | Liu et al. | 313/46 |
| 7,964,883 | B2 * | 6/2011 | Mazzochette et al. | 257/98 |
| 7,967,478 | B2 * | 6/2011 | Incerti et al. | 362/326 |
| 8,125,127 | B2 * | 2/2012 | Mo et al. | 313/113 |
| 2002/0084745 | A1 | 7/2002 | Wang et al. | |
| 2003/0038291 | A1 | 2/2003 | Cao | |
| 2003/0039122 | A1 | 2/2003 | Cao | |
| 2004/0057252 | A1 * | 3/2004 | Coushaine | 362/555 |
| 2004/0065894 | A1 | 4/2004 | Hashimoto | |
| 2004/0085766 | A1 * | 5/2004 | Chen et al. | 362/255 |
| 2004/0105262 | A1 * | 6/2004 | Tseng et al. | 362/241 |
| 2005/0189557 | A1 * | 9/2005 | Mazzochette et al. | 257/100 |
| 2006/0002110 | A1 | 1/2006 | Dowling et al. | |
| 2006/0146524 | A1 * | 7/2006 | Izardel | 362/183 |
| 2006/0209541 | A1 * | 9/2006 | Peck | 362/247 |
| 2006/0291209 | A1 | 12/2006 | Booth et al. | |
| 2007/0002572 | A1 * | 1/2007 | Ewig et al. | 362/470 |
| 2007/0019413 | A1 * | 1/2007 | Moore et al. | 362/296 |
| 2007/0267976 | A1 | 11/2007 | Bohler et al. | |
| 2008/0017872 | A1 | 1/2008 | Kim | |
| 2009/0021931 | A1 | 1/2009 | Mayer et al. | |
| 2009/0067180 | A1 * | 3/2009 | Tahmosybayat | 362/339 |
| 2009/0190362 | A1 * | 7/2009 | Peck et al. | 362/341 |
| 2009/0207605 | A1 * | 8/2009 | Fields | 362/231 |
| 2009/0207607 | A1 * | 8/2009 | Haase et al. | 362/234 |
| 2010/0027281 | A1 * | 2/2010 | Waters et al. | 362/470 |
| 2010/0109038 | A1 * | 5/2010 | Moore et al. | 257/98 |
| 2010/0207502 | A1 * | 8/2010 | Cao et al. | 313/46 |
| 2010/0213835 | A1 * | 8/2010 | Mo et al. | 313/512 |
| 2010/0301353 | A1 | 12/2010 | Pabst et al. | |

FOREIGN PATENT DOCUMENTS

| | | | |
|---|---|---|---|
| JP | 2004296245 | A | 10/2004 |
| JP | 2006005264 | A | 1/2006 |
| JP | 2006202612 | A | 8/2006 |
| JP | 2007188832 | A | 7/2007 |
| JP | 2008091140 | A | 4/2008 |
| JP | 2008159554 | A | 7/2008 |
| JP | 2008251663 | A | 10/2008 |
| JP | 2009021264 | A | 1/2009 |
| JP | 2009032590 | A | 2/2009 |
| TW | 489538 | A | 6/2002 |
| TW | 2003556364 | A1 | 10/2003 |
| TW | 200807770 | A | 2/2008 |

OTHER PUBLICATIONS

Notification of Transmittal of the International Search Report and the Written Opinion of the International Searching Authority, or the Declaration mailed Aug. 17, 2010 in PCT/US2010/37110.

European Supplementary Search Report; European Patent Office, Netherlands mailed Jun. 3, 2013; European Application No. 10784035.7 / PCT/US2010037119.

First Office Action dated Oct. 31, 2013 regarding China Patent Application No. 201080034336.

Taiwan Office Action dated Apr. 2, 2013 regarding Taiwan Application No. TW099117738.

Notice of Reasons for Rejection dated Mar. 5, 2013 regarding Japan Application No. JP2012514097.

Notice of Grounds for Rejection dated Jan. 31, 2013, regarding Korean Application No. KR20117031685.

* cited by examiner

LIGHT SOURCE WITH OPTICS TO PRODUCE A SPHERICAL EMISSION PATTERN

CROSS-REFERENCE TO RELATED APPLICATION

Pursuant to 35 U.S.C. §119(e), this application claims the benefit of U.S. Provisional Application Ser. No. 61/183,437 filed on Jun. 2, 2009, the contents of which is hereby incorporated by reference in its entirety.

BACKGROUND

1. Field

The present disclosure relates to light sources, and more particularly to light sources using optics to produce substantially spherical emission patterns.

2. Background

Solid state devices, such as light emitting diodes (LED)s, are attractive candidates for replacing conventional light sources such as incandescent, halogen and fluorescent lamps. LEDs have substantially higher light conversion efficiencies than incandescent and halogen lamps and longer lifetimes than all three of these types of conventional light sources. In addition, some types of LEDs now have higher conversion efficiencies than fluorescent light sources and still higher conversion efficiencies have been demonstrated in the laboratory. Finally, LEDs require lower voltages than fluorescent lamps and contain no mercury or other potentially dangerous materials, therefore, providing various safety and environmental benefits.

The typical LED has a lambertian emission pattern. This means that light emitted from the LED typically spans a hemispherical arc. This emission pattern may limit the use of LED light sources, or other solid state lighting devices, as replacements for conventional light sources for incandescent, halogen and fluorescent lamps, which emit light in all directions. An LED light source that is used in an incandescent light bulb, for example, may result in undesired dark spots in the downward direction. In common lighting applications, such as desk, floor, and table lamps, this can result in no downward light to enable work or reading tasks.

Accordingly, there is a need in the art for a solid state light source that has an emission pattern that better resembles conventional incandescent, halogen and fluorescent lamps.

SUMMARY

In one aspect of the disclosure, a light source includes a substrate, a plurality of solid state light emitting cells having a planar arrangement on the substrate, and one or more reflectors arranged with the solid state light emitting cells so that light emitted from the light source has a substantially spherical emission pattern.

In another aspect of the disclosure, a light source includes a substrate, a plurality of solid state light emitting cells arranged on the substrate to emit light in substantially the same direction, and one or more reflectors arranged with the solid state light emitting cells so that the light is emitted from the light source with a substantially spherical emission pattern.

In yet another aspect of the disclosure, a light source includes a substrate, a plurality of solid state light emitting cells having a substantially planar arrangement on the substrate, and means for reflecting light emitted from the solid state light emitting cells so that the light is emitted from the light source with a substantially spherical emission pattern.

In a further aspect of the disclosure, a lamp includes a housing having a base and a transparent bulb portion mounted to the base, and a light source within the housing. The light source includes a substrate, plurality of solid state light emitting cells having a substantially planar arrangement on the substrate, and one or more reflectors arranged with the solid state light emitting cells so that light emitted from the transparent bulb portion has a substantially spherical emission pattern.

In yet a further aspect of the disclosure, a lamp includes a housing having a base and a transparent bulb portion mounted to the base, a light source within the housing, the light source comprising a plurality of solid state light emitting cells and one or more reflectors arranged with the solid state light emitting cells so that light emitted from the light source has a substantially spherical emission pattern, and means for cooling the light source.

It is understood that other aspects of the present invention will become readily apparent to those skilled in the art from the following detailed description, wherein it is shown and described only exemplary configurations of a light source by way of illustration. As will be realized, the present invention includes other and different aspects of a light source and its several details are capable of modification in various other respects, all without departing from the spirit and scope of the present invention. Accordingly, the drawings and the detailed description are to be regarded as illustrative in nature and not as restrictive.

BRIEF DESCRIPTION OF THE FIGURES

Various aspects of the present invention are illustrated by way of example, and not by way of limitation, in the accompanying drawings, wherein.

DETAILED DESCRIPTION

Figure 1:
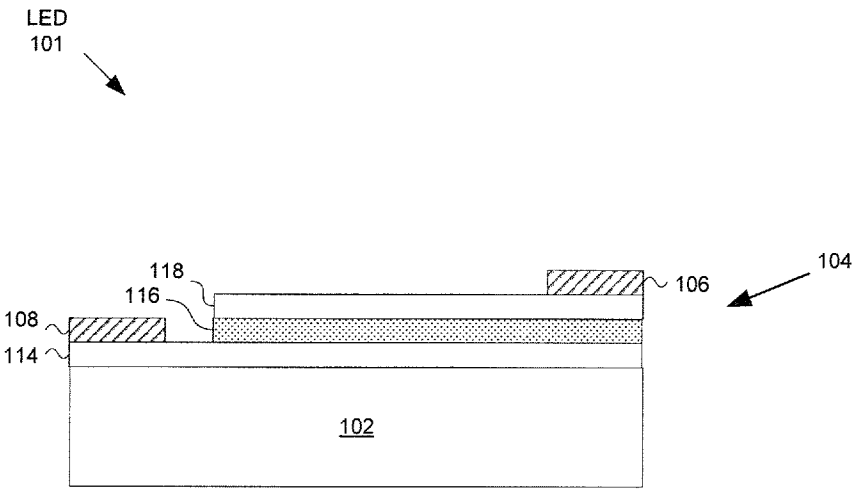
FIG. 1 is a conceptual cross-sectional side view illustrating an example of an LED.

The present invention is described more fully hereinafter with reference to the accompanying drawings, in which various aspects of the present invention are shown. This invention, however, may be embodied in many different forms and should not be construed as limited to the various aspects of the present invention presented throughout this disclosure. Rather, these aspects are provided so that this disclosure will be thorough and complete, and will fully convey the scope of the present invention to those skilled in the art. The various aspects of the present invention illustrated in the drawings may not be drawn to scale. Rather, the dimensions of the various features may be expanded or reduced for clarity. In addition, some of the drawings may be simplified for clarity. Thus, the drawings may not depict all of the components of a given apparatus or method.

Various aspects of the present invention will be described herein with reference to drawings that are schematic illustrations of idealized configurations of the present invention. As such, variations from the shapes of the illustrations as a result, for example, manufacturing techniques and/or tolerances, are to be expected. Thus, the various aspects of the present invention presented throughout this disclosure should not be construed as limited to the particular shapes of elements (e.g., regions, layers, sections, substrates, etc.) illustrated and described herein but are to include deviations in shapes that result, for example, from manufacturing. By way of example, an element illustrated or described as a rectangle may have rounded or curved features and/or a gradient concentration at its edges rather than a discrete change from one element to another. Thus, the elements illustrated in the drawings are schematic in nature and their shapes are not intended to illustrate the precise shape of an element and are not intended to limit the scope of the present invention.

It will be understood that when an element such as a region, layer, section, substrate, or the like, is referred to as being "on" another element, it can be directly on the other element or intervening elements may also be present. In contrast, when an element is referred to as being "directly on" another element, there are no intervening elements present. It will be further understood that when an element is referred to as being "formed" on another element, it can be grown, deposited, etched, attached, connected, coupled, or otherwise prepared or fabricated on the other element or an intervening element.

Furthermore, relative terms, such as "lower" or "bottom" and "upper" or "top," may be used herein to describe one element's relationship to another element as illustrated in the drawings. It will be understood that relative terms are intended to encompass different orientations of an apparatus in addition to the orientation depicted in the drawings. By way of example, if an apparatus in the drawings is turned over, elements described as being on the "lower" side of other elements would then be oriented on the "upper" side of the other elements. The term "lower", can therefore, encompass both an orientation of "lower" and "upper," depending of the particular orientation of the apparatus. Similarly, if an apparatus in the drawing is turned over, elements described as "below" or "beneath" other elements would then be oriented "above" the other elements. The terms "below" or "beneath" can, therefore, encompass both an orientation of above and below.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and this disclosure.

As used herein, the singular forms "a," "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. The term "and/or" includes any and all combinations of one or more of the associated listed items Various aspects of a light source will now be presented. However, as those skilled in the art will readily appreciate, these aspects may be extended to other light sources without departing from the spirit and scope of the invention. The light source may include a substrate, a plurality of solid state light emitting cells having an arrangement on the substrate, and one or more reflectors arranged with the solid state light emitting cells so that light emitted from the light source has a substantially spherical emission pattern. The light source may be used as a direct replacement for conventional light sources currently being used in incandescent, fluorescent, halogen, quartz, high-density discharge (HID), and neon lamps, to name a few.

An example of a solid state light emitting cell is an LED. The LED is well known in the art, and therefore, will only briefly be discussed to provide a complete description of the invention. FIG. 1 is a conceptual cross-sectional side view illustrating an example of an LED. An LED is a semiconductor material impregnated, or doped, with impurities. These impurities add "electrons" and "holes" to the semiconductor, which can move in the material relatively freely. Depending on the kind of impurity, a doped region of the semiconductor can have predominantly electrons or holes, which is referred to as n-type or a p-type semiconductor region, respectively. In LED applications, the semiconductor includes an n-type semiconductor region and a p-type semiconductor region. A reverse electric field is created at the junction between the two regions, which cause the electrons and holes to move away from the junction to form an active region. When a forward voltage sufficient to overcome the reverse electric field is applied across the p-n junction, electrons and holes are forced into the active region and combine. When electrons combine with holes, they fall to lower energy levels and release energy in the form of light.

Referring to FIG. 1, the LED 101 includes a substrate 102, an epitaxial-layer structure 104 on the substrate 102, and a pair of electrodes 106 and 108 on the epitaxial-layer structure 104. The epitaxial-layer structure 104 comprises an active region 116 sandwiched between two oppositely doped epitaxial regions. In this example, an n-type semiconductor region 114 is formed on the substrate 102 and a p-type semiconductor region 118 is formed on the active region 116, however, the regions may be reversed. That is, the p-type semiconductor region 118 may be formed on the substrate 102 and the n-type semiconductor region 114 may formed on the active region 116. As those skilled in the art will readily appreciate, the various concepts described throughout this disclosure may be extended to any suitable epitaxial-layer structure. Additional layers (not shown) may also be included in the epitaxial-layer structure 104, including but not limited to buffer, nucleation, contact and current spreading layers as well as light extraction layers.

The electrodes 106 and 108 may be formed on the surface of the epitaxial-layer structure 104. The p-type semiconductor region 118 is exposed at the top surface, and therefore, the p-type electrode 106 may be readily formed thereon. However, the n-type semiconductor region 114 is buried beneath the p-type semiconductor region 118 and the active region 116. Accordingly, to form the n-type electrode 108 on the n-type semiconductor region 114, a portion of the active region 116 and the p-type semiconductor region 118 is removed to expose the n-type semiconductor region 114 therebeneath. After this portion of the epitaxial-layer structure 104 is removed, the n-type electrode 108 may be formed.

Figure 2:
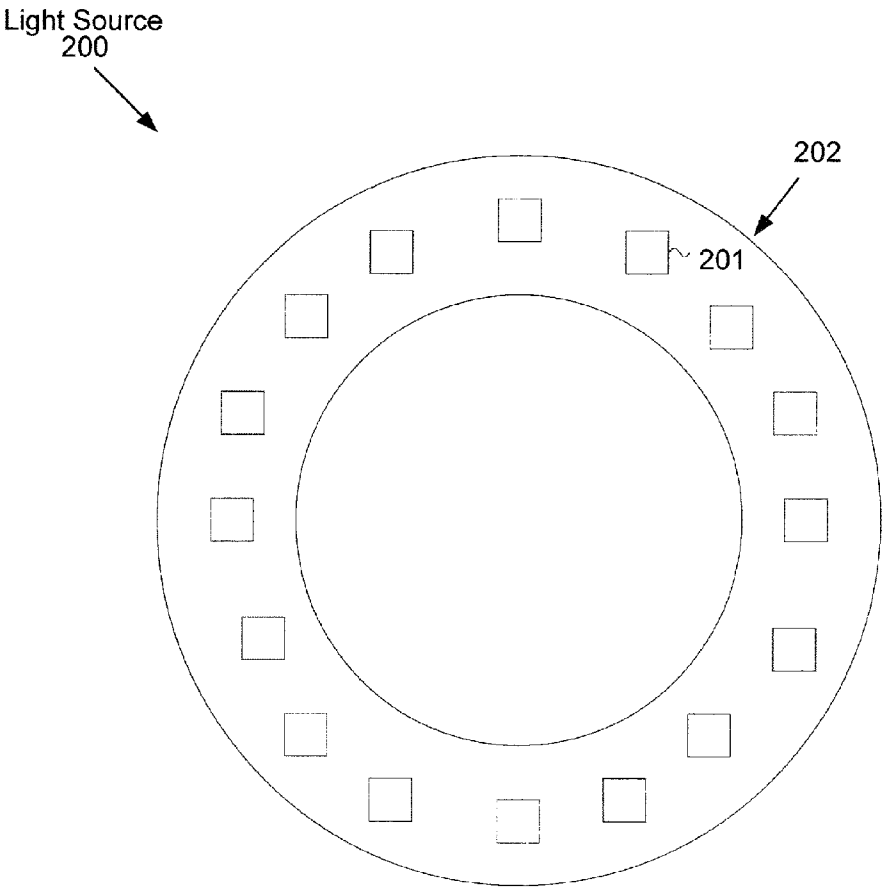
FIG. 2 is a conceptual top view illustrating an example of a light source.

In one configuration of a light source, multiple LEDs, or other light emitting cells, may be used to provide increased luminance. The light source may be constructed in a 2-dimensional planar fashion, or some other fashion. One example of a light source will now be presented with reference to FIG. 2. FIG. 2 is a conceptual top view illustrating an example of a light source. In this example, a light source 200 is configured with multiple LEDs 201 arranged on a substrate 202. The substrate 202 is shown as disc-shaped, but may have other shapes. By way of example, the substrate 202 could be circular, rectangular, or any other suitable shape. The substrate 202 may be made from any suitable material that provides mechanical support to the LEDs 201. Preferably, the material is thermally conductive to dissipate heat away from the LEDs 201. The substrate 202 may include a dielectric layer (not shown) to provide electrical insulation between the LEDs 201. The LEDs 201 may be electrically coupled in parallel and/or series by a conductive circuit layer, wire bonding, or a combination of these or other methods on the dielectric layer.

The light source may be configured to produce white light. White light may enable the light source to act as a direct replacement for conventional light sources used today in incandescent, halogen and fluorescent lamps. There are at least two common ways for producing white light. One way is to use individual LEDs that emit discrete wavelengths (such as red, green, blue, amber or other colors) and then mix all the colors to produce white light. The other way is to use a phosphor material or materials to convert monochromatic light emitted from a blue or ultra-violet (UV) LED to broad-spectrum white light. The present invention, however, may be practiced with other LED and phosphor combinations to produce different color lights.

Figure 3:
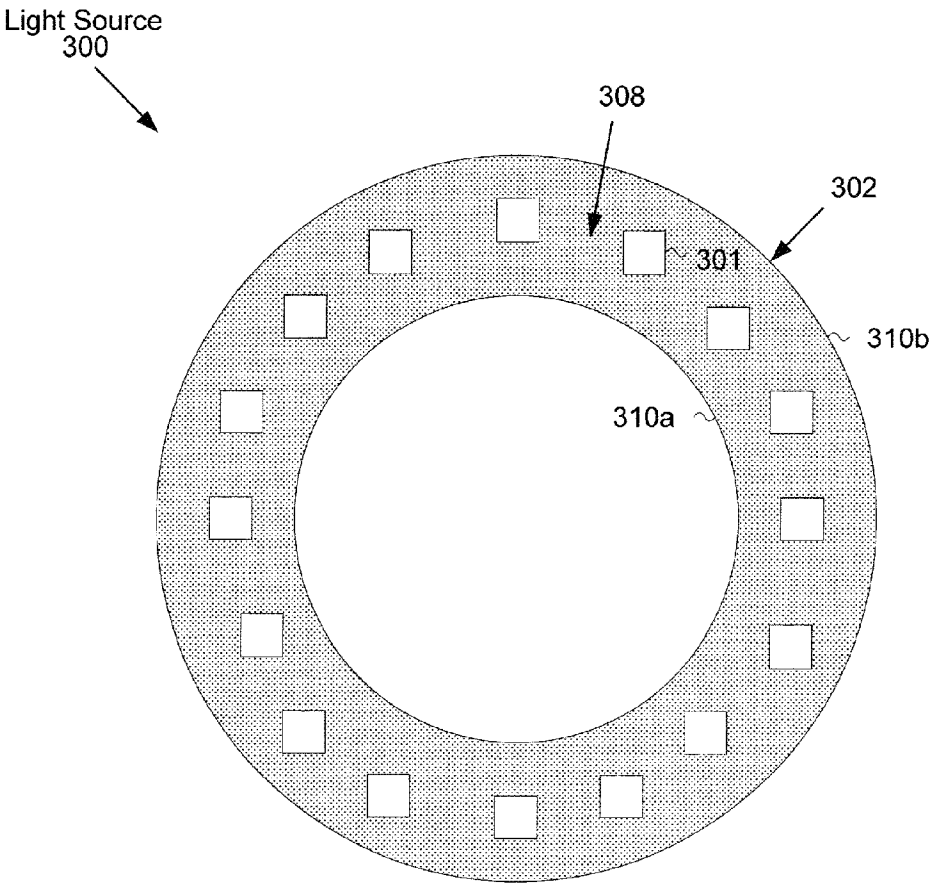
FIG. 3 is a conceptual top view illustrating an example of a white light source.

An example of a white light source will now be presented with reference to FIG. 3. FIG. 3 is a conceptual top illustrating an example of a white light source. The white light source 300 is shown with a substrate 302 which may be used to support multiple LEDs 301. The substrate 302 may be configured in a manner similar to that described in connection with FIG. 2 or in some other suitable way. The substrate may be disc-shaped as shown, or may have some other configuration. A phosphor material 308 may be deposited within a cavity defined by inner and outer boundaries 310*a*, 310*b*, respectively. The boundaries 310*a*, 310*b* may be formed with a suitable mold, or alternatively, formed separately from the substrate 302 and attached to the substrate 302 using an adhesive or other suitable means. The phosphor material 308 may include, by way of example, phosphor particles suspended in an epoxy, silicone, or other carrier or may be constructed from a soluble phosphor that is dissolved in the carrier.

In an alternative configuration of a white light source, each LED may have its own phosphor layer. As those skilled in the art will readily appreciate, various configurations of LEDs and other light emitting cells may be used to create a white light source. Moreover, as noted earlier, the present invention is not limited to solid state lighting devices that produce white light, but may be extended to solid state lighting devices that produce other colors of light.

Figure 4A:
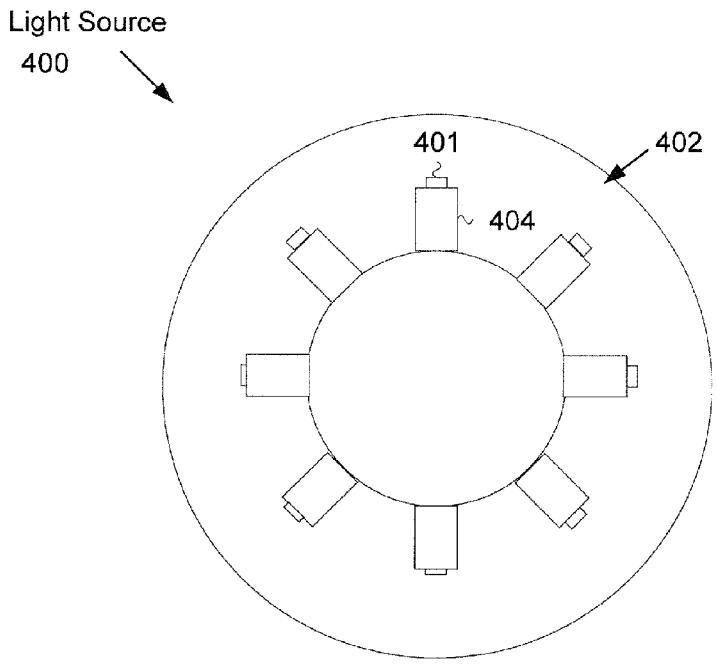
FIG. 4A is a conceptual top view illustrating an example of a light source having a substantially spherical emission pattern.
Figure 4B:
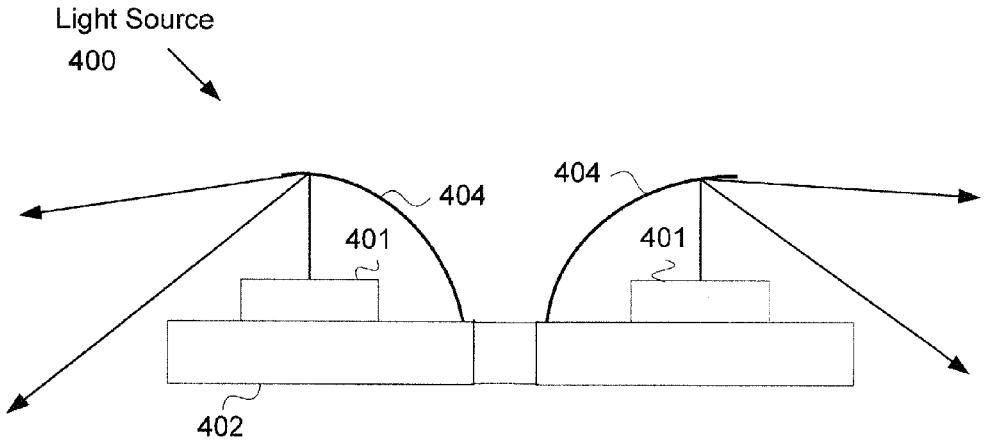
FIG. 4B is a conceptual cross-sectional side view of the light source of FIG. 4A.

The light source may also be configured with one or more reflectors arranged with the LEDs so that light emitted from the light source has a substantially spherical emission pattern. An example will now be presented with reference to FIGS. 4A and 4B. FIG. 4A is a conceptual top view illustrating an example of a light source having a substantially spherical emission pattern. FIG. 4B is a conceptual cross-sectional side view of the light source shown in FIG. 4A. In this example, a light source 400 includes a planar arrangement of LEDs 401 on a substrate 402. The substrate 402 is also used to support one or more reflectors which provide a means for reflecting light emitted from the LEDs 401 so that the light is emitted from the light source with a substantially spherical emission pattern. In this example, there are multiple reflectors 404. Each one of the reflectors 404 is cantilevered from the inner edge of the disc-shaped substrate 402 to form a lip that extends at least partially over a corresponding LED 401 at a slight upward incline. With this configuration, some of the emitted light is reflected downward by the corresponding reflector 404 while rest of the light is emitted unobstructed by the reflector 404. The result is an emission pattern that is substantially spherical, similar to that of a conventional incandescent lamp.

The emission pattern may be changed by varying any number of parameters. These parameters include the number and the positional arrangement of the LEDs 401 on the substrate 402, and the length and the inclination of the reflector 404 extending over the LEDs 401. By way of example, more light may be directed upwards by shortening the length of the reflectors 404, thereby exposing more of the LEDs 401. In contrast, more light may be directed downwards by increasing the length of the reflectors 404. These parameters may be varied to optimize the uniform distribution of light in applications where the light source is intended to be used as a replacement light source in conventional incandescent, halogen and fluorescent lamps. Alternatively, these parameters may be varied to direct more light downwards as may be required in the case of a desk, table, floor or reading lamp or other similar applications. Those skilled in the art will readily be to determine how best to vary these parameters for any particular lighting application based on the teachings presented throughout this disclosure.

Those skilled in the art will also recognize various configurations that may be used to produce a light source with a spherical, or otherwise desirable, emission pattern. By way of example, the length of one or more of the reflectors 404 may be different. Alternatively, or in addition to, one or more reflectors 404 may be used to partially or completely extend over some of the LEDs 401, while allowing the other LEDs 401 to exhibit a lambertian emission pattern unobstructed by any of the reflectors 404. The optical configuration used to produce a substantially spherical emission pattern may include multiple reflectors, as shown and described above, or alternatively, a single reflector that extends circumferentially along the entire inner edge of the substrate and is cantilevered to form a lip that extends partially over all the LEDs 401.

The reflector 404 may be fabricated by any means known in the art, now known or later developed. By way of example, the reflector 404 may include a plastic substrate with a reflective surface coated on the inside portion of the reflector 404. The plastic or other substrate material may be have a roughened surface or may be formed with multiple dimples so that the coated reflective surface scatters the reflected light emitted from the LED. The one or more reflectors 404 may be integrated with the substrate 402 and formed with a suitable mold, or alternatively, formed separately from the substrate 402 and attached to the substrate 402 using an adhesive or other suitable means.

Figure 5:
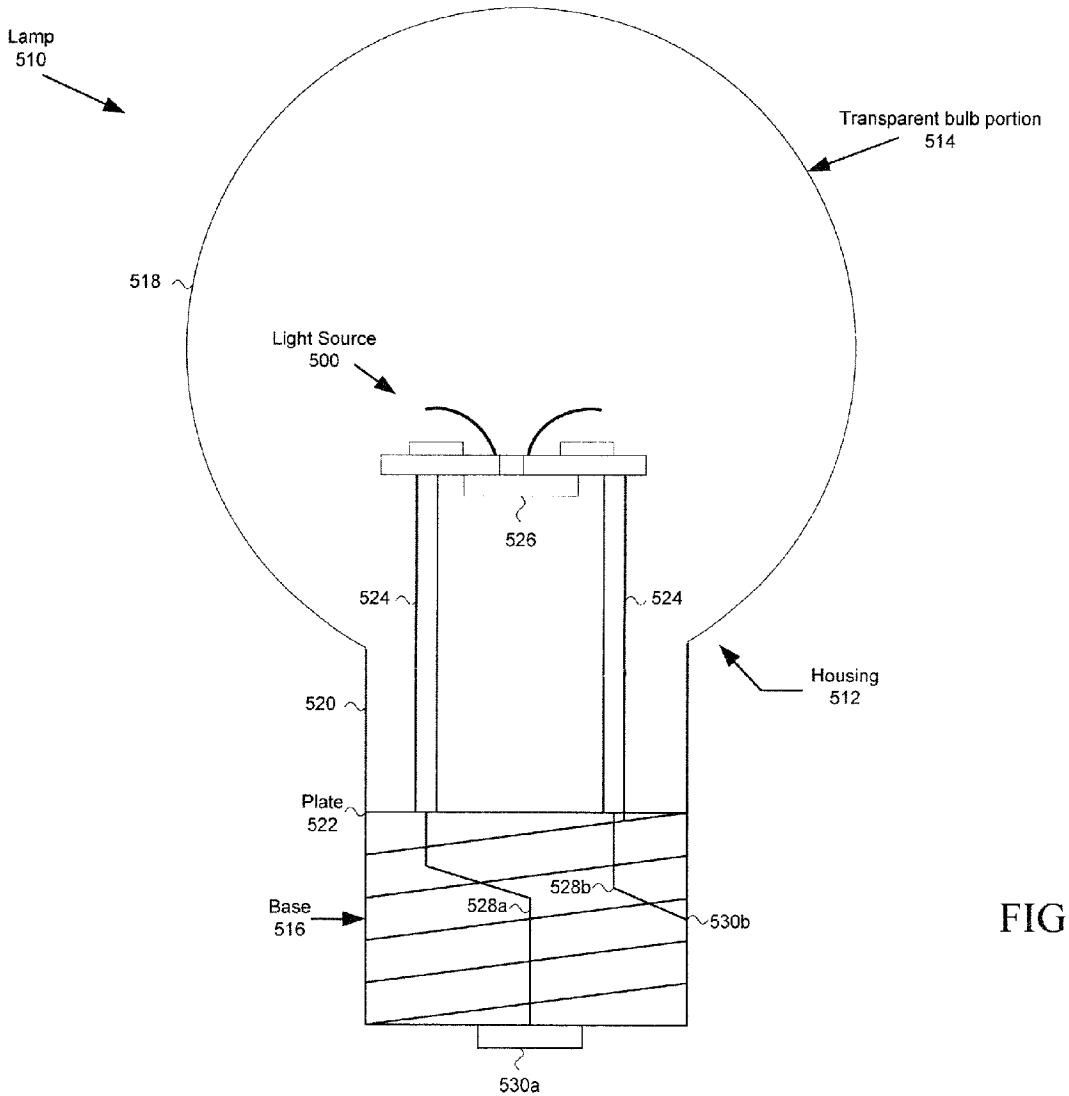
FIG. 5 is a conceptual cross-sectional side view of a lamp.

As noted earlier, a light source that produces a substantially spherical emission pattern from solid state light emitting cells is well suited to function as a replacement light source in conventional incandescent, halogen and fluorescent lamps. An example will now be presented with reference to FIG. 5. FIG. 5 is a conceptual side view illustrating an example of a lamp with a light source having solid state light emitting cells. The lamp 510 may include a housing 512 having a transparent bulb portion 514 (e.g., glass, plastic, etc.) mounted onto a base 516. The transparent bulb portion 514 may be have an internal diffusion coating to better diffuse the light emitted from the lamp 510. The internal surface of the transparent bulb portion 514 may also be coated with additional material that facilitates heat dissipation. Alternatively, the transparent bulb portion 514 may be filled with a fluid or gas that similarly provides diffusion and/or heat dissipation. The transparent bulb portion 514 is shown with a substantially circular or elliptical portion 518 extending from a neck portion 520, although the transparent bulb portion 514 may take on other shapes and forms depending on the particular application.

A light source 500 may be positioned within the housing 512. The light source 500 may take on various forms, including by way of example, the configuration presented earlier in connection with FIGS. 4A and 4B, or any other suitable configuration using an arrangement of solid state lighting emitting cells and optics to produce a substantially spherical emission pattern.

A plate 522 anchored to the base 516 provides support for the light source 500. In one configuration of a lamp 510, standoffs 524 extending from the plate 522 are used to separate the light source 500 from the plate 522. The plate 522 may be constructed from any suitable insulting material, including by way of example, glass. In the case of glass, the transparent bulb portion 514 of the housing 512 can be fused to the plate 522 to seal the light source 500.

A fan 526 may be used to cool the light source 500. The fan 526 may be an electronic fan or some other suitable device that generates airflow to cool the light source 500. An electronic fan is a device that generally exploits the concept of corona wind. Corona wind is a physical phenomenon that is produced by a strong electric field. These strong electric fields are often found at the tips of electrical conductors where electric charges, which reside entirely on the surface of the conductor, tend to accumulate. When the electric field reaches a certain strength, known as the corona discharge inception voltage gradient, the surrounding air is ionized with the same polarity as the tip of the conductor. The tip then repels the ionized air molecules surrounding it, thereby creating airflow. A non-limiting example of an electronic fan that exploits corona wind to generate airflow is an RSD5 solid-state fan developed by Ventiva or Thorrn Micro Technologies, Inc. The fan 526 may be mounted to the light source 500 as shown in FIG. 5, but may be mounted elsewhere in the housing 512. Those skilled in the art will be readily able to determine the location of the fan best suited for any particular application based on the overall design parameters.

Alternatively, heat pipes may be used to both support the light source 500 above the plate 522 and to dissipate heat away from the light source 500. In connection with the latter function, the heat pipes may be used in conjunction with, or instead of, the fan 526. The heat pipes may extend through a stack of spaced apart thermally conductive plates in the base 516, which function to dissipate heat away from the heat pipes through multiple vents in the base 516.

The plate 522 also provides a means for routing wires 528*a* and 528*b* from the light source 500 to electrical contacts 530*a* and 530*b* on the base 516. In one configuration of a lamp 510, the standoffs 524 previously described may be hollow, and the wires 528*a* and 528*b* may be routed from the plate 522 to the light source 500 through the hollow standoffs 524. In another configuration of a lamp 510, the wires 528*a* and 528*b* themselves can be used to separate the light source 500 from the plate 522, thus eliminating the need for standoffs 524. In the latter configuration, the wires 528*a* and 528*b* may be spot welded to feedthrough holes in the plate 522 with another set of spot welded wires extending from the feedthrough holes to the electrical contacts 530*a* and 530*b* on the base 516.

The arrangement of electrical contacts 530*a* and 530*b* and physical shape of the connecting lamp base may vary depending on the particular application. By way of example, the lamp 510 may have a base 516 with a screw cap configuration, as shown in FIG. 5, with one electrical contact 530*a* at the tip of the base 516 and the screw cap serving as the other electrical contact 530*b*. Contacts in the lamp socket (not shown) allow electrical current to pass through the base 516 to the light source 500. Alternatively, the base may have a bayonet cap with the cap used as an electrical contact or only as a mechanical support. Some miniature lamps may have a wedge base and wire contacts, and some automotive and special purpose lamps may include screw terminals for connection to wires. The arrangement of electrical contacts for any particular application will depend on the design parameters of that application.

Power may be applied to the light source 500 and the fan 526 through the electrical contacts 530*a* and 530*b*. An AC-DC converter (not shown) may be used to generate a DC voltage from a lamp socket connected to a wall-plug in a household, office building, or other facility. The DC voltage generated by the AC-DC converter may be provided to a driver circuit (not shown) configured to drive both the light source 500 and the fan 526. The AC-DC converter and the driver circuit may be located in the base 516, in the light source 500, or anywhere else in the housing 512. In some applications, the AC-DC converter may not be needed. By way of example, the light source 500 and the fan 526 may be designed for AC power. Alternatively, the power source may be DC, such as the case might be in automotive applications. The particular design of the power delivery circuit for any particular application is well within the capabilities of one skilled in the art.

As discussed in greater detail earlier, a white light source may be constructed from a substrate carrying multiple blue or UV LEDs and a phosphor material to produce a white light source. Alternatively, the phosphor material may be formed on the inner surface of transparent bulb portion 514 of the housing 512 to produce a white light source. In another configuration of a lamp, a white light source may be produced by embedding the phosphor material in the transparent bulb portion 514 of the housing 512. These concepts are more fully described in U.S. patent application Ser. No. 12/360,781, entitled "Phosphor Housing for Light Emitting diode Lamp," the contents of which is incorporated by reference as though fully set forth herein.

The various aspects of this disclosure are provided to enable one of ordinary skill in the art to practice the present invention. Various modifications to aspects presented throughout this disclosure will be readily apparent to those skilled in the art, and the concepts disclosed herein may be extended to other lamp configurations regardless of the shape or diameter of the glass enclosure and the base and the arrangement of electrical contacts on the lamp. By way of example, these concepts may be applied to bulb shapes commonly referred to in the art as A series, B series, C-7/F series, ER, G series, GT, K, P-25/PS-35 series, BR series, MR series, AR series, R series, RP-11/S series, PAR Series, Linear series, and T series; ED17, ET, ET-18, ET23.5, E-25, BT-28, BT-37, BT-56. These concepts may also be applied to base sizes commonly referred to in the art as miniature candela screw base E10 and E11, candela screw base E12, intermediate candela screw base E17, medium screw base E26, E26D, E27 and E27D, mogul screw base E39, mogul Pf P40s, medium skirt E26/50×39, candela DC bay, candela SC bay B15, BA15D, BA15S, D.C. Bayonet, 2-lug sleeve B22d, 3-lug sleeve B22-3, medium Pf P28s, mogul bi-post G38, base RSC, screw terminal, disc base, single contact, medium bi-post, mogul end prong, spade connector, mogul pre-focus and external mogul end prong; admedium skirted, medium skirted, position-oriented mogul, BY 22 D, Fc2, ceramic spade series (J, G, R), RRSC, RSC; single pin series, bi-pin series, G, GX, 2G series. Thus, the claims are not intended to be limited to the various aspects of this disclosure, but are to be accorded the full scope consistent with the language of the claims. All structural and functional equivalents to the elements of the various aspects described throughout this disclosure that are known or later come to be known to those of ordinary skill in the art are expressly incorporated herein by reference and are intended to be encompassed by the claims. Moreover, nothing disclosed herein is intended to be dedicated to the public regardless of whether such disclosure is explicitly recited in the claims. No claim element is to be construed under the provisions of 35 U.S.C. §112, sixth paragraph, unless the element is expressly recited using the phrase "means for" or, in the case of a method claim, the element is recited using the phrase "step for."

What is claimed is:

1. A light source, comprising:

a disc-shaped substrate;

a plurality of solid state light emitting cells having a substantially planar arrangement on the substrate; and one or more reflectors, each comprising an unbroken surface, the one or more reflectors arranged with the solid state light emitting cells and shaped as a continuous curve so that light emitted from the light source has a substantially spherical emission pattern, wherein each of the one or more reflectors is cantilevered from an inner edge of the disc-shaped substrate to form a lip that extends partially over a solid state light emitting cell such that an outer edge of the solid state light emitting cell is configured to emit at least a portion of the light in an upward direction past the reflector, and wherein the one or more reflectors is configured to reflect at least a portion of the light in a downward direction.

2. The light source of claim 1 further comprising phosphor arranged with the solid state light emitting cells so that the light emitted from the light source is white light.

3. The light source of claim 1 wherein each of the one or more reflectors is supported by the substrate.

4. The light source of claim 1 wherein each of at least one of the one or more reflectors extends over said at least one of the solid state light emitting cells with an upward incline.

5. The light source of claim 1 wherein the one or more reflectors extend at least partially over all of the solid state light emitting cells.

6. The light source of claim 1 wherein the one or more reflectors comprises one reflector.

7. The light source of claim 1 wherein the one or more reflectors comprise a plurality of reflectors.

8. The light source of claim 7 wherein each of the reflectors extend at least partially over a different one of the solid state light emitting cells.

9. The light source of claim 1 wherein each of the one or more reflectors has a light scattering reflective surface facing the solid state light emitting cells.

10. A light source, comprising:

a disc-shaped substrate;

a plurality of solid state light emitting cells arranged on the substrate to emit light in substantially the same direction; and one or more reflectors, each comprising an unbroken surface, the one or more reflectors arranged with the solid state light emitting cells and shaped as a continuous curve so that the light is emitted from the light source with a substantially spherical emission pattern;

wherein each of the one or more reflectors is cantilevered from an inner edge of the disc-shaped substrate to form a lip that extends partially over a solid state light emitting cell such that an outer edge of the solid state light emitting cell configured to emit at least a portion of the light in an upward direction past the reflector, and wherein the one or more reflectors is configured to reflect at least a portion of the light in a downward direction.

11. The light source of claim 10 further comprising phosphor arranged with the solid state light emitting cells so that the light emitted from the light source is white light.

12. The light source of claim 10 wherein each of the one or more reflectors is supported by the substrate.

13. The light source of claim 10 wherein each of at least one of the one or more reflectors extends over said at least one of the solid state light emitting cells with an upward incline.

14. The light source of claim 10 wherein the one or more reflectors extend at least partially over all of the solid state light emitting cells.

15. The light source of claim 10 wherein the one or more reflectors comprises one reflector.

16. The light source of claim 10 wherein the one or more reflectors comprise a plurality of reflectors.

17. The light source of claim 16 wherein each of the reflectors extend at least partially over a different one of the solid state light emitting cells.

18. The light source of claim 10 wherein each of the one or more reflectors has a light scattering reflective surface facing the solid state light emitting cells.

19. A light source, comprising:

a disc-shaped substrate;

a plurality of solid state light emitting cells having a substantially planar arrangement on the substrate; and means for reflecting light emitted from the solid state light emitting cells, the means for reflecting light shaped as a continuous curve so that the light is emitted from the light source with a substantially spherical emission pattern, the light reflecting means comprising an unbroken surface, wherein the means for reflecting light comprises one or more reflectors, each cantilevered from an inner edge of the disc-shaped substrate to form a lip that extends partially over a solid state light emitting cell such that an outer edge of the solid state light emitting cell is configured to emit at least a portion of the light in an upward direction past the reflector, and wherein the means for reflecting light is configured to reflect at least a portion of the light in a downward direction.

20. The light source of claim 19 further comprising phosphor arranged with the solid state light emitting cells so that the light emitted from the light source is white light.

21. The light source of claim 19 wherein the one or more reflectors is supported by the substrate.

22. The light source of claim 19 wherein each of at least one of the one or more reflectors extends over said at least one of the solid state light emitting cells with an upward incline.

23. The light source of claim 19 wherein the one or more reflectors extend at least partially over all of the solid state light emitting cells.

24. The light source of claim 19 wherein the one or more reflectors comprises one reflector.

25. The light source of claim 19 wherein the one or more reflectors comprise a plurality of reflectors.

26. The light source of claim 25 wherein each of the reflectors extend at least partially over a different one of the solid state light emitting cells.

27. The light source of claim 19 wherein each of the one or more reflectors has a light scattering reflective surface facing the solid state light emitting cells.

28. A lamp, comprising:

a housing having a base and a transparent bulb portion mounted to the base;

a light source within the housing, the light source comprising:

a disc-shaped substrate;

a plurality of solid state light emitting cells having a substantially planar arrangement on the substrate; and one or more reflectors, each comprising an unbroken surface, the one or more reflectors arranged with the solid state light emitting cells and shaped as a continuous curve so that light emitted from the transparent bulb portion has a substantially spherical emission pattern;

wherein each of the one or more reflectors is cantilevered from an inner edge of the disc-shaped substrate to form a lip that extends partially over a solid state light emitting cell such that an outer edge of the solid state light emitting cell is configured to emit at least a portion of the light in an upward direction past the reflector, and wherein the one or more reflectors is configured to reflect at least a portion of the light in a downward direction.

29. The lamp of claim 28 further comprising phosphor arranged with the solid state light emitting cells so that the light emitted from the transparent bulb portion is white light.

30. The lamp of claim 28 wherein each of the one or more reflectors is supported by the substrate.

31. The lamp of claim 28 wherein each of at least one of the one or more reflectors extends over said at least one of the solid state light emitting cells with an upward incline.

32. The lamp of claim 28 wherein the one or more reflectors extend at least partially over all of the solid state light emitting cells.

33. The lamp of claim 28 wherein the one or more reflectors comprises one reflector.

34. The lamp of claim 28 wherein the one or more reflectors comprise a plurality of reflectors.

35. The lamp of claim 34 wherein each of the reflectors extend at least partially over a different one of the solid state light emitting cells.

36. The lamp of claim 28 wherein each of the one or more reflectors has a light scattering reflective surface facing the solid state light emitting cells.

37. The lamp of claim 28 further comprising a fan arranged within the housing to cool the solid state light emitting cells.

38. The lamp of claim 28 wherein the base is configured to electrically and mechanically mate with a lamp socket.

39. The lamp of claim 28 wherein the base comprises electrical contacts coupled to the solid state light emitting cells.

40. The lamp of claim 39 wherein the base comprises a cap configured to mechanically mate with the lamp socket, the cap comprising one of the electrical contacts.

41. The lamp of claim 40 wherein the base further comprises a tip having another one of the electrical contacts.

42. The lamp of claim 40 wherein the cap comprises a screw cap.

43. A lamp, comprising:

a housing having a base and a transparent bulb portion mounted to the base;

a light source within the housing, the light source comprising a plurality of solid state light emitting cells arranged on a disc-shaped substrate and one or more reflectors, each comprising an unbroken surface, the one or more reflectors arranged with the solid state light emitting cells and shaped as a continuous curve so that light emitted from the light source has a substantially spherical emission pattern;

wherein each of the one or more reflectors is cantilevered from an inner edge of the disc-shaped substrate to form a lip that extends partially over a solid state light emitting cell such that an outer edge of the solid state light emitting cell is configured to emit at least a portion of the light in an upward direction past the reflector, and wherein the one or more reflectors is configured to reflect at least a portion of the light in a downward direction; and means for cooling the light source.

44. The lamp of claim 43 wherein the means for cooling the light source comprises a fan mounted to the light source to cool the solid state light emitting cells.

45. The lamp of claim 44 wherein the fan comprises an electronic fan.

46. The lamp of claim 43 wherein the means for cooling the light source comprises one or more heat pipes supporting the light source.

47. The lamp of claim 46 wherein the means for cooling the light source further comprises a plurality of spaced apart thermally conductive plates in the base, wherein the one or more heat pipes are arranged with the plates to dissipate heat generated by the solid state light emitting cells.

48. The lamp of claim 46 wherein the means for cooling the light source further comprises a plurality of spaced apart thermally conductive plates in the base, wherein the one or more heat pipes extend through the plates.

49. The lamp of claim 46 wherein the means for cooling the light source further comprises one or more vents in the base, wherein the one or more heat pipes are arranged with the vents to dissipate heat generated by the one or more solid state light emitting cells.

50. The lamp of claim 43 wherein the solid state light emitting cells have a planar arrangement on the substrate.

51. The lamp of claim 43 wherein the solid state light emitting cells are arranged on the substrate to emit light in substantially the same direction.

* * * * *